US010273743B2

(12) United States Patent
Gosling et al.

(10) Patent No.: US 10,273,743 B2
(45) Date of Patent: Apr. 30, 2019

(54) POCKET DOOR

(71) Applicant: DIRTT Environmental Solutions, LTD., Calgary (CA)

(72) Inventors: Geoff Gosling, Calgary (CA); Mogens Smed, DeWinton (CA); Colin Blehm, Calgary (CA); Martin Fitchett, Calgary (CA)

(73) Assignee: DIRTT Environmental Solutions, Ltd., Calgary (CA)

( * ) Notice: Subject to any disclaimer, the term of this patent is extended or adjusted under 35 U.S.C. 154(b) by 0 days.

(21) Appl. No.: 15/038,781

(22) PCT Filed: Mar. 11, 2016

(86) PCT No.: PCT/US2016/022112

§ 371 (c)(1),
(2) Date: May 24, 2016

(87) PCT Pub. No.: WO2016/145370

PCT Pub. Date: Sep. 15, 2016

(65) Prior Publication Data

US 2017/0362881 A1 Dec. 21, 2017

Related U.S. Application Data

(60) Provisional application No. 62/131,782, filed on Mar. 11, 2015.

(51) Int. Cl.
*E05D 13/00* (2006.01)
*E06B 3/46* (2006.01)
(Continued)

(52) U.S. Cl.
CPC ..... *E06B 3/4654* (2013.01); *E05F 1/16* (2013.01); *E05F 5/003* (2013.01); *E05Y 2800/24* (2013.01); *E05Y 2900/14* (2013.01)

(58) Field of Classification Search
CPC ..... E06B 3/4654; E05F 1/16; E05Y 2800/24; E05Y 2900/14
(Continued)

(56) References Cited

U.S. PATENT DOCUMENTS 2,561,079 A * 7/1951 Trammell, Sr. ..... E06B 3/4654 16/90
2,732,919 A * 1/1956 Johnson, Jr. ..... E05D 15/0652 16/90
(Continued)

FOREIGN PATENT DOCUMENTS

CN 2492666 Y 5/2002
EP 2098669 A1 9/2009
(Continued)

OTHER PUBLICATIONS ntemational Search Report and Written Opinion for application No. PCT/US2016/022112 dated Jun. 27, 2016.
(Continued)

*Primary Examiner* — Jerry E Redman
(74) *Attorney, Agent, or Firm* — Workman Nydegger

(57) ABSTRACT

A modular wall system with an integrated pocket door includes a frame defining a wall plane and a doorway. The system also includes one or more aesthetic panels connected to at least a portion of the frame so as to cover at least a portion of the wall frame. Additionally, the system includes a support member extending above the doorway and across at least a portion of the wall plane. The support member includes an integrated track that is accessible through one or more access windows integrated into the support member. The system includes a slideable pocket door integrated into the track such that when closed, the pocket door blocks the doorway, and when open, the pocket door is at least partially enclosed behind the one or more aesthetic panels.

22 Claims, 8 Drawing Sheets

(51) Int. Cl.
*E05F 5/00* (2017.01)
*E05F 1/16* (2006.01)

(58) Field of Classification Search
USPC ..... 49/372, 323, 409, 425; 52/207, 29
See application file for complete search history.

(56) References Cited

U.S. PATENT DOCUMENTS 2,818,608 A * 1/1958 Ill ..... E06B 3/4654 49/372
3,058,174 A * 10/1962 Sterling ..... E06B 3/4654 49/372
3,100,916 A * 8/1963 McKinney ..... E05D 15/0656 49/125
3,400,490 A * 9/1968 Anderson ..... E05D 15/06 49/372
3,480,989 A * 12/1969 Edeus ..... E06B 3/4636 16/94 R
4,325,204 A * 4/1982 Martine ..... E06B 3/4654 49/372
4,385,470 A * 5/1983 Bryson ..... E06B 5/11 49/372
4,561,210 A * 12/1985 Kvas ..... E06B 3/4654 49/372
4,742,645 A * 5/1988 Johnston ..... E06B 3/4654 49/372
5,394,658 A * 3/1995 Schreiner ..... A47B 21/06 312/196
5,974,742 A * 11/1999 Schreiner ..... A47B 21/06 52/239
6,058,655 A * 5/2000 Gravel ..... B60P 7/14 49/306
6,145,630 A * 11/2000 Friedman ..... B66B 13/08 187/313
6,497,075 B1 * 12/2002 Schreiner ..... A47B 21/06 52/127.6
6,938,375 B2 * 9/2005 Duncan ..... E05L 31/0015 49/372
7,568,311 B2 * 8/2009 Shivak ..... E04L 32/7455 49/409
8,353,120 B2 * 1/2013 Burns ..... G09F 7/10 40/486
8,402,606 B1 * 3/2013 Tsai ..... E05F 3/18 16/49
8,458,957 B2 * 6/2013 Guzzi-Nicolia .... E05D 15/0626 49/372
8,561,352 B2 * 10/2013 Vogler ..... E05F 1/16 49/138
9,009,918 B2 * 4/2015 Haab ..... E05D 15/0652 16/105
9,863,178 B2 * 1/2018 Wang ..... E05F 5/02
2006/0145007 A1 * 7/2006 Melberg ..... B64C 1/1469 244/118.5
2008/0006594 A1 * 1/2008 Layton ..... E06B 3/4654 211/162
2008/0271392 A1 * 11/2008 Rapson ..... E06B 3/4654 52/207
2008/0302020 A1 12/2008 Gosling et al.
2009/0056228 A1 * 3/2009 Picchio ..... E05D 15/0617 49/415
2010/0043172 A1 * 2/2010 Nezu ..... E05B 65/0858 16/71
2011/0023370 A1 * 2/2011 Zimmer ..... E05F 1/16 49/360
2011/0067313 A1 * 3/2011 Walhorn ..... E05F 1/16 49/360
2011/0167588 A1 * 7/2011 Chang ..... E05F 5/003 16/71
2011/0179718 A1 * 7/2011 Martin ..... E04L 32/827 49/413
2012/0255232 A1 10/2012 Gayhart
2014/0075853 A1 3/2014 Keller et al.
2015/0047150 A1 2/2015 Saito
2016/0040465 A1 * 2/2016 Wang ..... E05F 1/16 16/49
2016/0060935 A1 3/2016 Nilsson
2016/0298370 A1 * 10/2016 Druckman ..... B64D 11/0606
2017/0051554 A1 * 2/2017 Dastrup ..... E06B 3/4654

FOREIGN PATENT DOCUMENTS

EP 2330269 6/2011
EP 2098669 10/2014
WO 2013178240 12/2013
WO 2015181530 12/2015

OTHER PUBLICATIONS

International Search Report and Written Opinion for Singapore application No. 11201606344Q dated Mar. 16, 2017.
Supplementary European Search Report for application No. EP 16762642 dated on Jan. 30, 2018.
International Search Report and Written Opinion for application No. 11201606344q dated Apr. 16, 2018.

* cited by examiner

POCKET DOOR

CROSS-REFERENCE TO RELATED APPLICATIONS

The present invention is a 35 U.S.C. § 371 U.S. National Stage of PCT Application No. PCT/US2016/22112, filed Mar. 11, 2016, which claims the benefit of priority to U.S. Patent Application No. 62/131,782, filed Mar. 11, 2015. The entire content of each of the foregoing patent applications is incorporated herein by reference.

BACKGROUND OF THE INVENTION

1. Technical Field

The present disclosure relates generally to architectural doors.

2. Background and Related Art

Office space can be relatively expensive, not only due to the basic costs of the location and size of the office space, but also due to any construction needed to configure the office space in a particular way. An organization might purchase or rent a large open space in an office complex, and then subdivide or partition the open space into various offices, conference rooms, or cubicles, depending on the organization's needs and size constraints. Rather than having to find new office space and move as an organization's needs change, it is often necessary to have a convenient and efficient means to reconfigure the existing office space. Many organizations address their configuration and reconfiguration issues by dividing large, open office spaces into individual work areas using modular walls and partitions.

In particular, at least one advantage of modular systems is that they are relatively easy to configure. In addition, another advantage is that modular systems can be less expensive to set up, and can be reconfigured more easily than more permanently constructed office dividers. For example, a set of offices and a conference area can be carved out of a larger space in a relatively short period of time with the use of modular systems. If needs change, the organization can readily reconfigure the space.

In general, modular office partitions typically include a series of individual wall modules (and/or panels). The individual wall modules can either be free-standing or rigidly attached to one or more support structures. In addition, the wall modules are typically designed so that they can be assembled together to form a range of different configurations. In particular, a manufacturer or assembler can usually align and join the various wall modules together in almost any particular design, and then secure the design in place with any number of fasteners. These designs can include anything from large conference spaces to individual offices. A "finished" look is generally completed by adding gaskets or trim pieces in the joints between wall modules.

In addition, one will appreciate that many modular wall partitions will need to implement a closure apparatus, such as a door. Doors are manufactured for use in a variety of settings including both exterior as well as interior settings. Manufacturers fabricate doors to suit the end uses found in the various applications in which the doors are to be used. In turn, doors provide a convenient way to enter and exit structures or interior spaces as well as to selectively open and close entrances. The necessary configuration of a particular door is determined by the specific requirements of the site where the door is being installed. These requirements may dictate the direction a door is to be opened, the type of door to be used, the configuration of mounting hardware, and how the door is to be installed, among other aspects.

One particular use for doors is in conjunction with modular wall systems used to reconfigurably divide interior spaces. Of course, there are many types of doors from which to choose. In some cases, a manufacturer or designer will opt for a conventional swinging door, while in other cases, the manufacturer might opt for a sliding door configuration, such as a pocket door, whether for various aesthetic or space saving purposes.

Conventional pocket doors can be extremely difficult to incorporate into an architectural scheme. Typical pocket doors can be difficult to install, and almost impossible to adjust. Once a conventional pocket door is installed, the door is virtually unserviceable because it is essentially trapped.

Accordingly, there are a number of disadvantages in the art of architectural pocket doors.

BRIEF SUMMARY

Certain embodiments described herein comprise systems, methods, and devices configured to easily incorporate a pocket door within a modular architecture scheme. In particular, some embodiments comprise devices and systems for easily installing a pocket door in a manner that is completely integrated within a modular wall system. Additionally, certain embodiments comprise devices and systems for easily accessing and adjusting an already-installed pocket door.

Certain embodiments comprise a modular wall system with an integrated pocket door. The modular wall system can comprise a frame defining a wall plane and a doorway. Some embodiments also include one or more aesthetic panels connected to at least a portion of the frame defining the wall plane. In some embodiments, the system includes a support member (e.g., a horizontal load-bearing beam) extending above the doorway and across at least a portion of the wall plane. In at least some embodiments, the support member includes an integrated track that is accessible through one or more access windows integrated into the support member.

Certain embodiments include a pocket door slideably integrated into the track of the support member such that when closed, the pocket door blocks the doorway, and when open, the pocket door is at least partially enclosed behind the one or more aesthetic panels.

Certain embodiments include one or more roller mechanisms coupled to a top of the pocket door and at least partially disposed within the integrated track. Certain embodiments include one or more damping mechanisms configured to interact with the one or more roller mechanisms to dampen movement of the pocket door upon opening or shutting of the pocket door.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE FIGURES

In order to describe the manner in which the above recited and other advantages and features of the invention can be obtained, a more particular description of the invention briefly described above will be rendered by reference to specific embodiments thereof, which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

The present disclosure extends to systems, methods, and devices configured to easily incorporate a pocket door within a modular architecture scheme. In particular, implementations of the present disclosure comprise devices and systems for easily installing a pocket door in a manner that is completely integrated within a modular wall system. Additionally, implementations of the present disclosure comprise devices and systems for easily accessing and adjusting an already-installed pocket door.

Accordingly, implementations of the present disclosure allow designers and users to easily integrate pocket doors within their architectural structures. In particular, implementations of the present disclosure provide pocket doors that are easily installed, completely integrated within a modular wall system, and easy to maintain. For example, implementations of the present disclosure comprise pocket doors that can be accessed by simply removing aesthetic panels from a modular wall system and adjusting various features of the pocket door through an access window.

Figure 1:
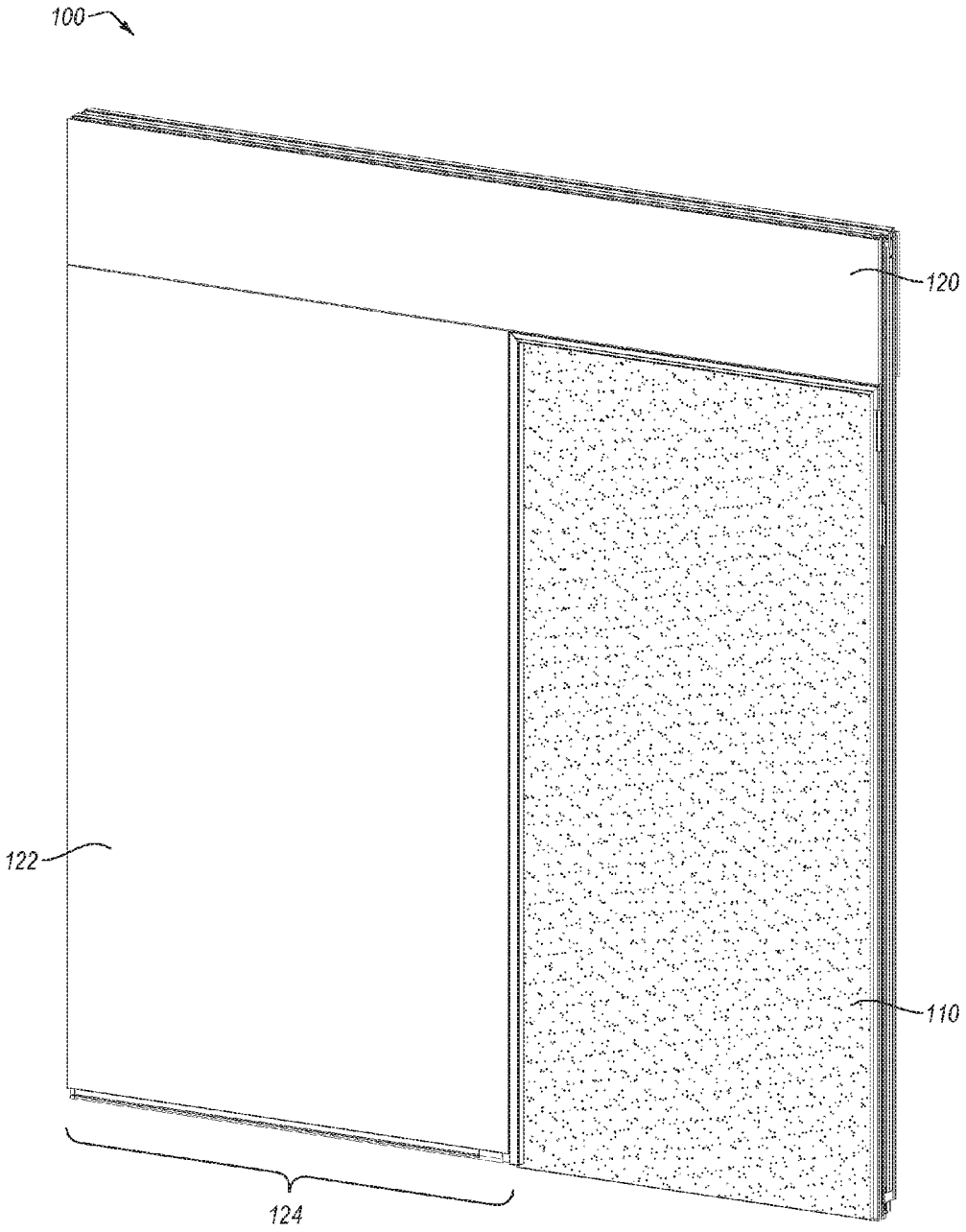
FIG. 1 illustrates an embodiment of a modular wall system comprising a number of detachable and reconfigurable panels and comprising a pocket door, in accordance with implementations of the present disclosure.

FIG. 1 illustrates one embodiment of a modular wall system 100. The illustrated modular wall system 100 includes a pocket door 110 slideably connected within a frame of the modular wall system 100 such that when closed, the pocket door 110 blocks a doorway, and when open, the pocket door 110 is hidden from view or at least partially hidden from view by panels 120 and 122 in a wall plane 124. The panels 120 and 122 may be formed as aesthetic or decorative panels. Additionally, or alternatively, the panels 120 and 122 may provide one or more functional features, such as providing privacy and/or damping sound and noise.

The illustrated embodiment includes an upper panel 120 and a lower panel 122 (e.g., for a given side of the modular wall system 100). Alternative embodiments may include different numbers of panels and/or differently configured panels, such as panels of different sizes, shapes, orientations, and/or arrangements, and panel configurations may be selected to provide a desired aesthetic and/or functional effect.

Figure 2:
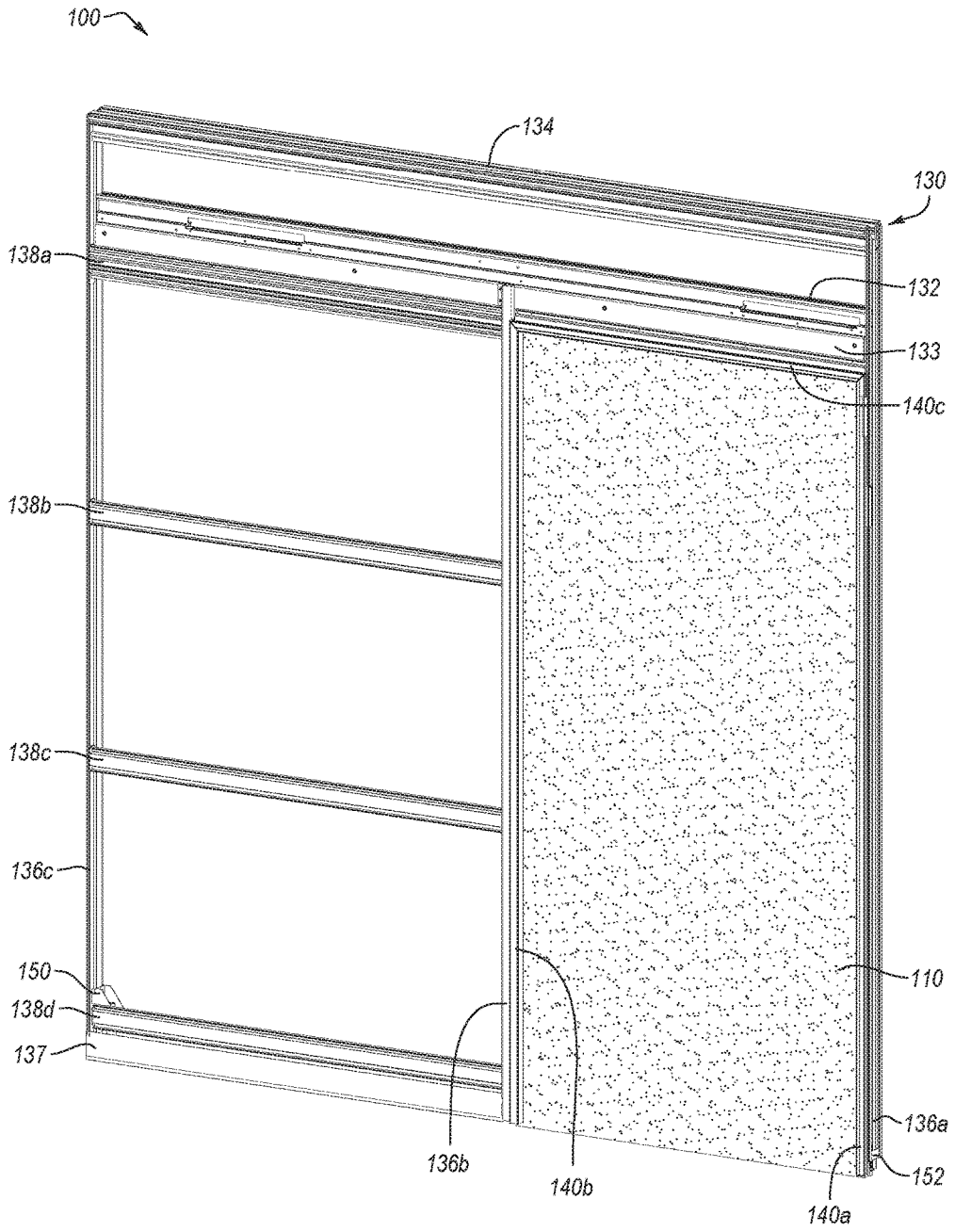
FIG. 2 illustrates the modular wall system with panels removed to show additional components of the system, and with the pocket door shown in a closed position.

FIG. 2 illustrates the modular wall system 100 with the panels 120 and 122 removed. As shown, the modular wall system 100 includes a frame 130. The illustrated frame 130 includes a support frame member 132, an upper frame member 134, vertical frame members 136*a*, 136*b*, and 136*c*, a base frame member 137, and horizontal frame members 138*a*, 138*b*, 138*c*, and 138*d*. Alternative embodiments may include other arrangements of frame members, such as different numbers of vertical and horizontal frame members, different connectivity between frame members, and different orientations of frame members.

One of ordinary skill in the art will understand, in light of this disclosure, alternative arrangements of frame members for providing a suitable frame for the modular wall system. Further, although this disclosure may refer to certain frame members as "vertical" or "horizontal," this is not meant to convey that such frame members must be perfectly vertical or horizontal. Rather, these terms, as used herein, refer to frame members that are generally upright or generally horizontal when positioned to form the frame of the modular wall system. In addition, frame members that are angled, and/or frame members that are somewhat diagonally attached or oriented, are included within the disclosure as alternative embodiments.

The frame 130 is configured to allow the selective attachment of panels, architectural accessories, structural components, and/or other architectural components for various aesthetic and/or functional purposes. The frame may be formed from metals (e.g., aluminum, stainless steel), wood, plastics, combinations thereof, and/or other suitable framing materials. In some embodiments, one or more frame members may include or be formed at least partially from a soft and/or elastomeric material. For example, base frame member 137 may at least partially be formed from a soft and/or elastomeric material in order to dampen vibrations and/or wobbles of the pocket door 110 as the pocket door 110 is translated along the base member 137. In some embodiments, one or more trim elements may be associated with (e.g., attached to or positioned against) one or more portions of the frame 130, as explained further below.

The illustrated modular wall system 100 also includes trim elements 140*a*, 140*b*, and 140*c* (collectively referred to herein as "trim elements 140"). In some implementations, the trim elements 140 are configured to assist in aligning the pocket door 110 properly within the frame 130 of the modular wall system 100 (e.g. to keep the pocket door 110 in a co-planar positional relationship with the various frame members of the frame 130).

In some embodiments, one or more of the trim elements 140 are formed from a soft and/or elastomeric material. In some embodiments, one or more of the trim elements 140 are configured to be attachable to corresponding frame elements with a "snap-on" fit. Additionally, or alternatively, one or more trim elements 140 may be attachable to the frame 130 via screws or other mechanical fasteners, adhesives, and/or other attaching means. In some embodiments, one or more trim elements are configured to be positionable flush against one or more members of the frame 130.

In some embodiments, the trim element 140*a* is configured as a docking element to receive the pocket door 110 when the pocket door 110 is positioned in a closed position (as shown in FIG. 2). In one example, the trim element 140*a* is attached to the vertical frame member 130*a*, and the soft and/or elastomeric material of the trim element 140*a* functions to dampen the impact between the pocket door 110 and the vertical frame member 130*a*.

In addition, in some embodiments, the trim element 140*a* assists in aligning the pocket door 110 with the frame 130 of the modular wall system 100, such that the pocket door 110 remains in a proper coplanar position with the frame members of the frame 130 when engaged with the trim element 140*a* in the closed position. For example, the trim element 140*a* may be formed with a slot or channel sized to receive and/or engage with the closing side of the pocket door 110 when the pocket door 110 is closed, and the slot or channel may be configured in size and shape to properly align the pocket door 110 and/or prevent unwanted wobbling of the pocket door 110.

In some embodiments, the trim element 140*b* is configured to dampen vibrations, wobbles, or other undesired movements that the pocket door 110 may experience during opening and closing. For example, the trim element 140*b* may be formed as two separate pieces that are attached to or positioned against vertical frame member 130*b* on either side of the pocket door 110, such that the pocket door 110 passes between the two pieces of the trim element 140*b* when sliding between open and closed positions. In some embodiments, the trim element 140*b* is configured in size and shape to restrict excess wobbling or other movement of the pocket door 110 and/or to maintain proper co-planar position of the pocket door 110. In alternative embodiments, the trim element 140*b* is formed as one integral piece. For example, the trim element 140*b* may be formed as one integral piece having a slot sized to allow passage of the pocket door 110 through the trim element 140*b*.

In some embodiments, the trim element 140*c* is also configured to assist in damping vibrations and/or wobbles that the pocket door 110 may experience during opening and closing, and to assist in maintaining proper coplanar position of the pocket door 110 to the frame 130. In some embodiments, the trim element 140*c* is configured as two separate pieces positioned on the support frame member 132 so as to be on opposite sides of the pocket door 110. Alternatively, the trim element 140*c* may be formed as one integral piece having a channel or slit sized and shaped to allow the pocket door 110 to translate through the trim element 140*c*.

In the illustrated embodiment, the pocket door 110 is suspended by the support frame member 132. As shown, the support frame member 132 is associated with a brace 133 configured to function as a stiffener to add structural support to the support frame member 132 (e.g., on one or more sides of the support frame member 132). In alternative embodiments, the brace 133 may be omitted or may be integrally joined to the support frame member 132. In some embodiments, the brace 133 is formed separate from the support frame member 132 and is detachable from the support frame member 132 in order to provide access to underlying components of the modular wall system 100, as described in further detail below.

In the illustrated embodiment, the support frame member 132 includes an integrated track configured to allow the pocket door 110 to slide along at least a portion of the length of the support frame member 132. The support frame member 132 may be configurable to hold and/or support different pocket door shapes, sizes, widths, and/or lengths. For example, in at least one embodiment, the support frame member 132 is configured to hold a pocket door weighing up to a range of about 300 pounds to about 400 pounds.

The illustrated modular wall system 100 also includes leveling devices 150 and 152 configured to enable height adjustment and leveling of the modular wall system 100 (e.g., through adjusting a threaded rod relative to a corresponding threaded base). Some embodiments may include one or more of such leveling devices.

Figure 3:
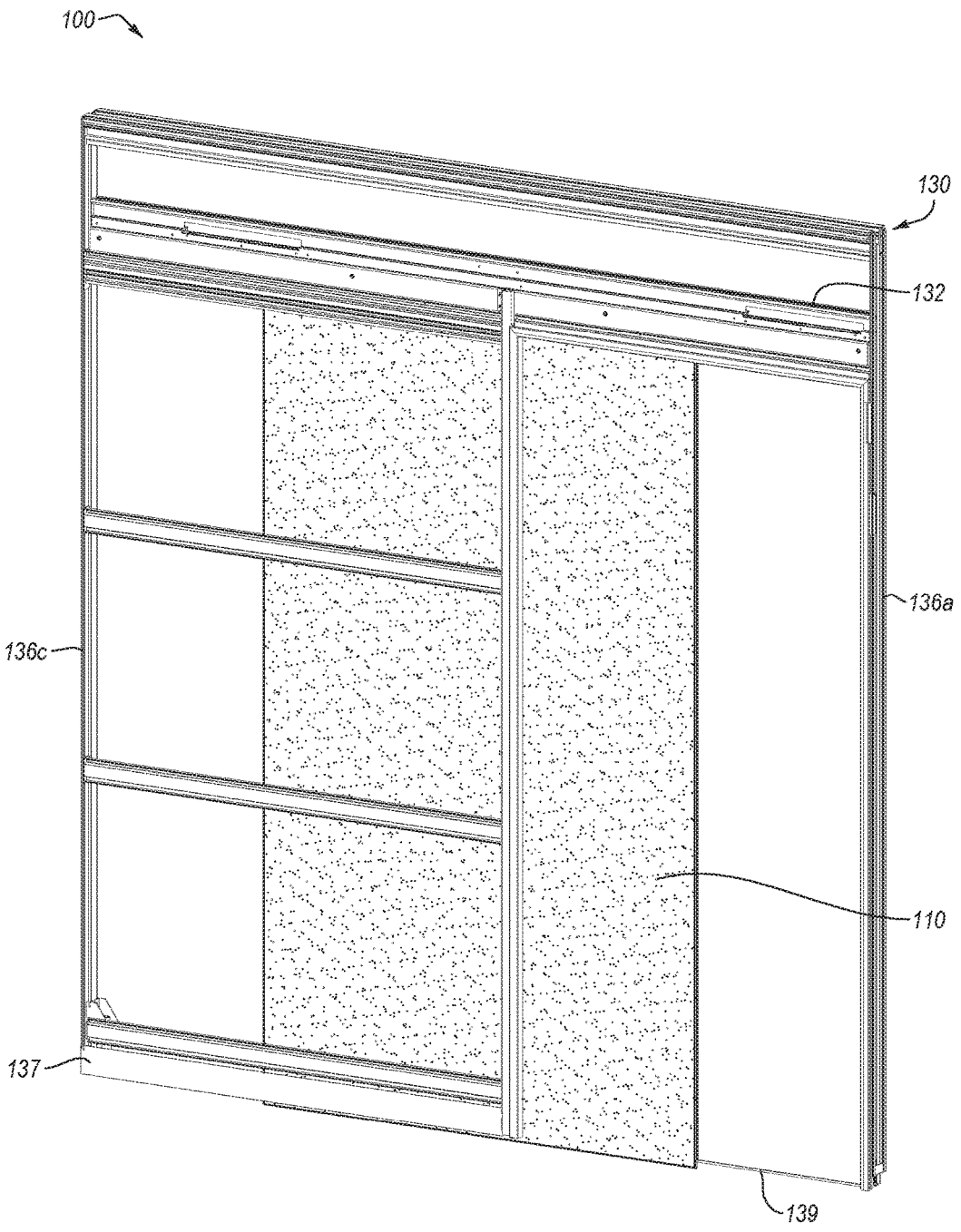
FIG. 3 illustrates the modular wall system with the pocket door shown in a partially-open position.

FIG. 3 illustrates the modular wall system 100 showing the pocket door 110 moving toward an open position relative to the closed position shown in FIG. 2. As shown, the pocket door 110 may be translated along the integrated track of the support frame member 132 so as to move further away from the vertical frame member 136*a* and further toward the vertical frame member 136*c*. In the illustrated embodiment, the modular wall system 100 also includes a guide 139 configured to engage with a channel formed in the bottom of the pocket door 110 to assist in guiding the pocket door 110 properly (e.g., to keep it coplanar with the frame 130) as it is moved between open and closed positions.

In some embodiments, the base frame member 137 is configured to further support and/or guide the pocket door 110. For example, the base frame member may include a track or channel (not shown) for receiving the pocket door 110 as the pocket door 110 translates along the base frame member 137. In some embodiments, the base frame member 137 is associated with a trim element or is at least partially formed from a soft and/or elastomeric material configured to prevent wobbling and vibrating of the pocket door 110 when positioned within or translating across the base frame member 137. Some embodiments omit the guide 139 and/or the base frame member 137. In some embodiments, the support frame member 132 supports the entire weight of the pocket door 110.

Figure 4:
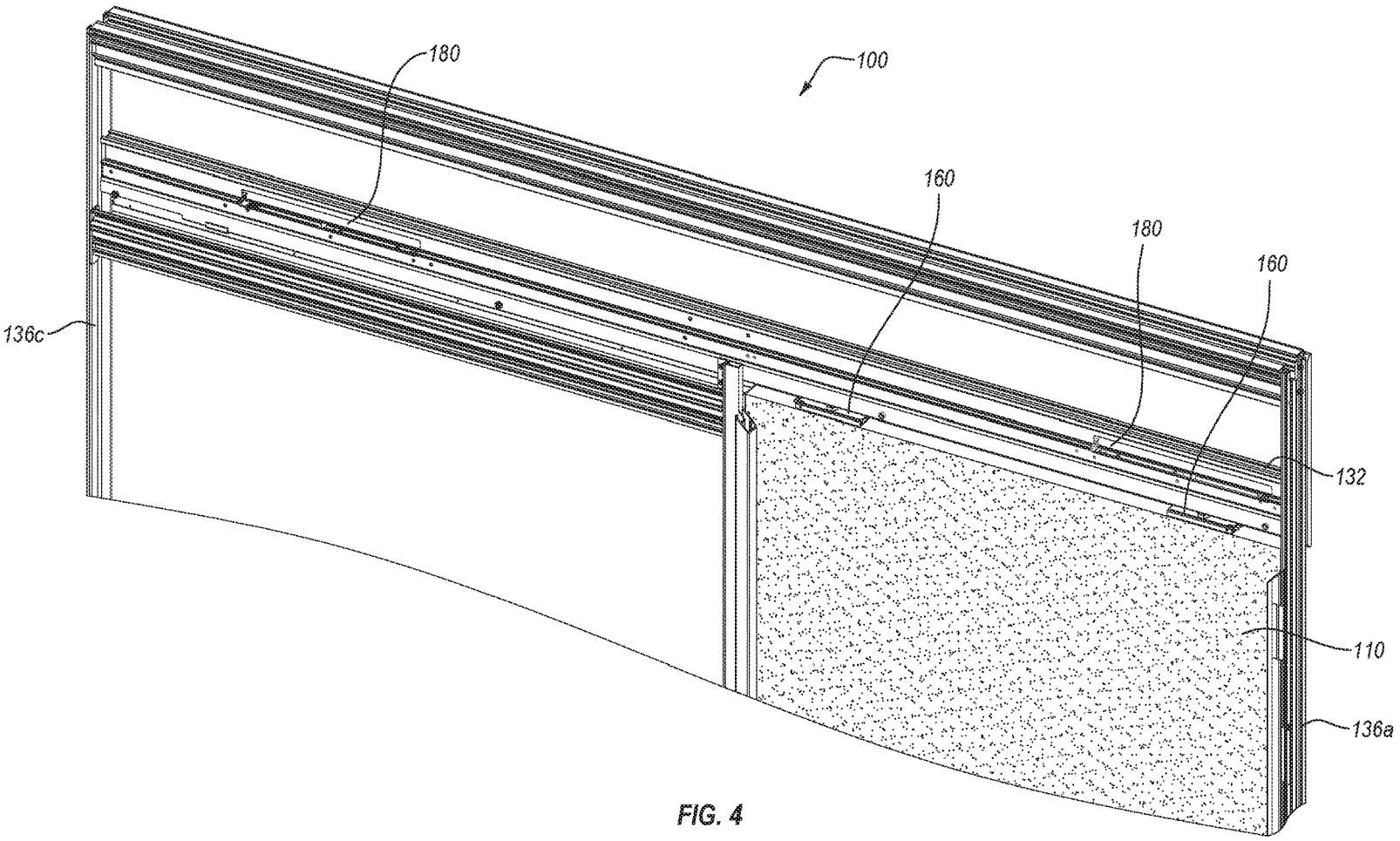
FIG. 4 illustrates the modular wall system with portions of a support member removed to show translatable attachment of the pocket door to the support member.

FIG. 4 illustrates the modular wall system 100 with portions of the brace 133 removed to show the translatable attachment of the pocket door 110 to the support member 132. As shown, a number of roller mechanisms 160 are attached to the pocket door 110 and extend into the integrated track of the support member 132. In the illustrated embodiment, the support member 132 includes a number of access windows 180. The access windows 180 may be cut, formed, or otherwise integrated into the support member 132 in such a way that the track, one or more roller mechanisms 160, and/or one or more damping mechanisms (described in more detail below) within the support member 132 can be accessed.

The illustrated embodiment includes two access windows 180, with one positioned near a closed-door side of the support member 132 (i.e., near vertical frame member 136*a*), and one positioned near an open-door side of the support member 132 (i.e., near vertical frame member 136*c*). Other embodiments include different numbers and/or positions of access windows. For example, some embodiments may include an access window positioned near the center of the support member 132.

The illustrated embodiment also includes two roller mechanisms 160 positioned generally near opposite ends of the pocket door 110. Alternative embodiments include different numbers and/or positions of roller mechanisms, such as including one or more roller mechanisms positioned near the center of the pocket door 110.

Figure 5:
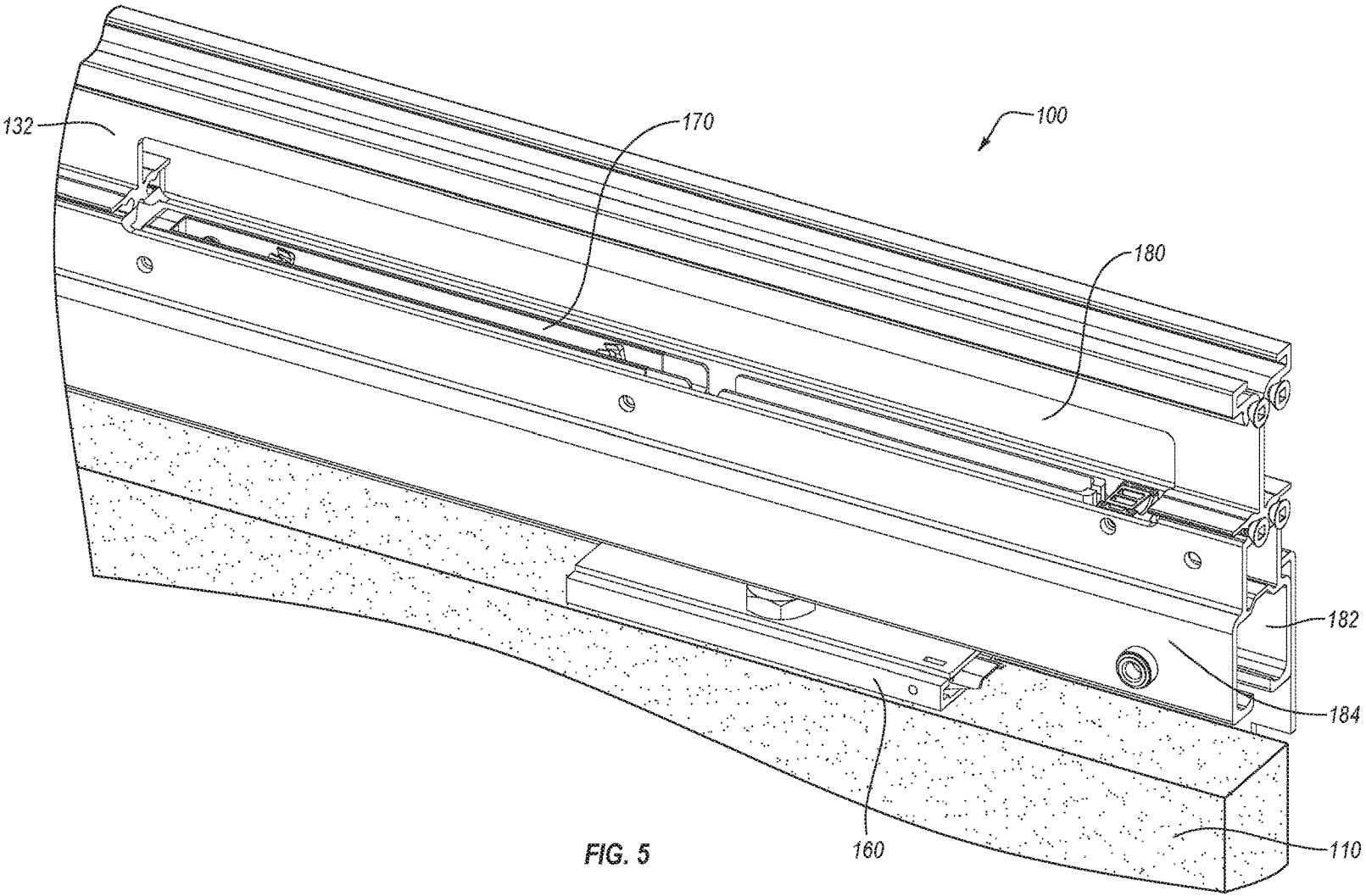
FIG. 5 is a magnified view of the support member showing an access window, roller mechanism, and damping mechanism.

FIG. 5 illustrates an enlarged view of the pocket door 110 and support frame member 132, with further portions of the frame removed. As shown, the roller mechanism 160 is attached to the pocket door 110 and extends into the track portion 182 of the support member 132. A portion of a damping mechanism 170 is shown through the access window 180. In the illustrated embodiment, the damping mechanism 170 may be accessed through the access window 180 in order to, for example, adjust, remove, replace, or otherwise interact with the damping mechanism 170. In some embodiments, the access window 180 can also provide access to the roller mechanism 160, the track portion 182, and/or other nearby interior components. Additionally, or alternatively, other access windows may be formed within the support member 132, such as at areas along the outer surface 184 of the track portion 182 (e.g., below the illustrated access window 180) in order to provide direct access to the track portion 182, the roller mechanism 160, and/or other components.

One or more access windows 180 can enable and/or assist a user to make adjustments to a currently hanging pocket door 110, to remove a pocket door 110 from a frame, to mount a pocket door 110 to a frame, or to otherwise access a currently hanging pocket door 110. In some embodiments, there is an access window 180 for each roller device 160 attached to the pocket door 110. As such, in at least one embodiment, the entire pocket door 110 can be removed from the support member 132 with a single action, such as by aligning each roller device 160 with a corresponding access window.

Additionally, in some embodiments, the access window 180 is positioned such that it would typically be covered by one or more panels. Accordingly, some embodiments provide a simple system for installing, accessing, and otherwise adjusting a pocket door 110 through simple detaching of one or more panels, without typically requiring adjustments or modifications to the frame and while maintaining an aesthetically pleasing design within a modular wall system.

Figure 6:
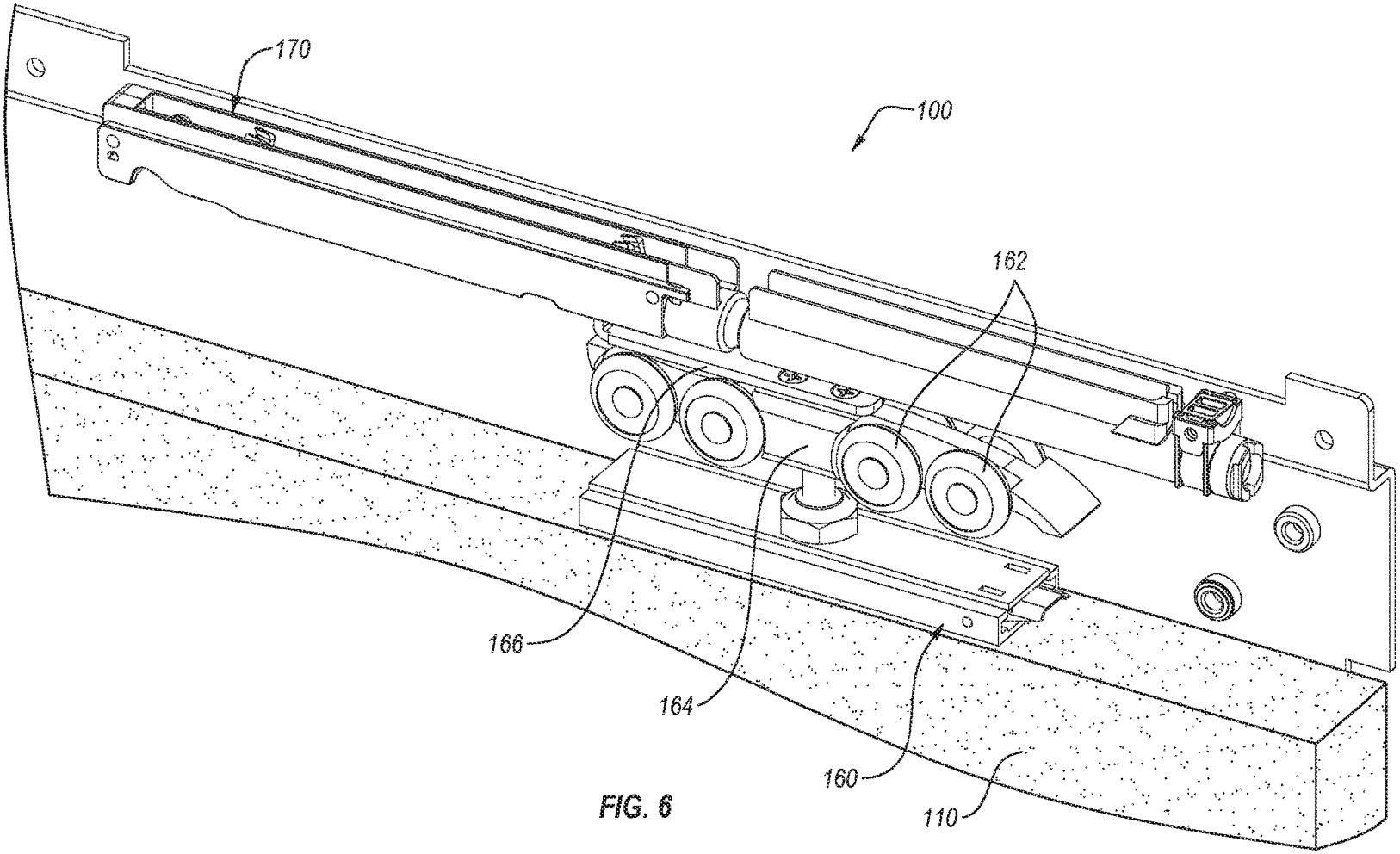
FIG. 6 illustrates a magnified view of the support member with further portions of the support member removed to show engagement between the roller mechanism and the damping mechanism.

FIG. 6 illustrates a magnified view with further portions of the support member 132 removed to show engagement between the roller mechanism 160 and the damping mechanism 170. In the illustrated embodiment, the roller mechanism 160 includes a plurality of wheels 162 attached to a body 164, and a latch 166 attached to the body 164. In the illustrated embodiment, the latch 166 is configured to engage with the damping mechanism 170 as the roller mechanism is brought into contact with the damping mechanism 170 in order to provide damping or soft-stopping functionality to the modular wall system 100. For example, as the pocket door 110 is moved toward a closed position, the roller mechanism is moved along the track until it contacts the damping mechanism 170.

As explained in more detail below, the latch 166 enables the roller mechanism to engage with the damping mechanism 170 such that the damping mechanism 170 is able to dampen the closing movement of the pocket door 110 in order to, for example, prevent overly abrupt stops, hitting of the pocket door 110 against the frame, bounce-back of the pocket door 110 to an open or partially open position, and/or other problems associated with undampened (e.g., too rapid and/or too forceful) movement of the pocket door 110. Additionally, or alternatively, although embodiments of damping mechanisms are typically described herein in terms of operation during the closing of a pocket door, the same mechanisms and functions are equally applicable to the opening of a pocket door. For example, a mirror-image assembly of the damping mechanism and roller mechanism may be used on an opposite side of the modular wall system 100 to prevent overly abrupt or forceful opening of the pocket door 110.

As shown, the latch 166 allows the roller mechanism 160 to interact with the damping mechanism 170 without requiring the roller mechanism 160 to be linearly positioned with respect to the damping mechanism 170 (e.g., towards the interior from the damping mechanism 170). Instead, as illustrated, the roller mechanism 160 may be positioned so as to be below the damping mechanism 170 during interaction with and operation of the damping mechanism 170. This configuration allows more effective placement of roller mechanisms 160 on a pocket door 110.

For example, instead of necessitating that the roller mechanisms be located toward the interior of the associated damping mechanisms, which would require the roller mechanisms to be positioned more centrally on the pocket door 110, the roller mechanism 160 may be placed further towards the outer portion of a pocket door 110 while still providing interaction with the damping mechanism 170. Better support for the pocket door 110 (e.g., less tendency to rock or sway) is enabled when it is supported from outer portions rather than from more centrally located portions.

The illustrated configuration can also provide access to both the roller mechanism 160 and the damping mechanism 170 through the same access window. For example, an access window configured to provide access to the damping mechanism 170 can also provide access to a roller mechanism 160 positioned underneath the damping mechanism (e.g., positioned as illustrated). A wider access window would be required in order to access both the roller mechanism and the damping mechanism if the roller mechanism 160 were positioned linear to the damping mechanism 170.

Figure 7:
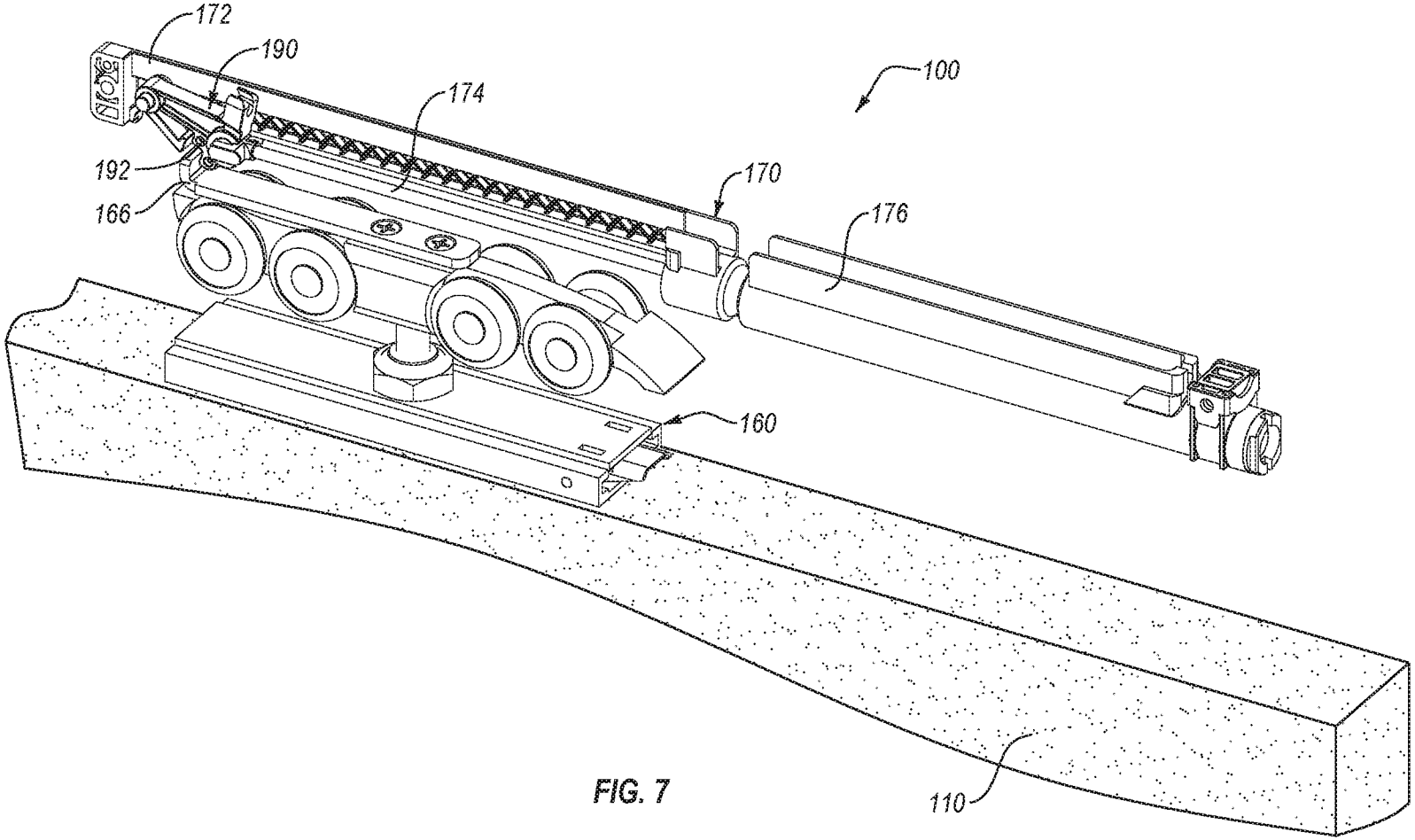
FIGS. 7 and 8 illustrate progressive movement of the pocket door toward a closed position, showing the roller mechanism coming into contact with the damping mechanism and engaging with the damping mechanism during closing of the pocket door.

FIG. 7 illustrates a magnified view of an embodiment showing the roller mechanism 160 coming into contact with the damping mechanism 170. A section of the medial portion 172 of the damping mechanism 170 has been removed in order to more clearly show a catch 190 and a rod 174 of the damping mechanism 170. As shown, as the roller mechanism 160 is moved toward the damping mechanism 170 (i.e., to the right from the perspective of FIG. 7), the latch 166 will engage with the corresponding catch 190. In the illustrated embodiment, the catch 190 includes a first face 192 that faces in a medial direction and is configured to contact the latch 166 as the latch moves laterally toward the closed position.

The catch 190 is configured to engage with the rod 174, such that a force from the movement of the pocket door 110 is transferred from the latch 166 of the roller mechanism 160 to the catch 190, and from the catch 190 to the rod 174. The rod 174 is configured to absorb the force and dampen movement according to preset or user adjusted parameters. For example, the damping mechanism 170 may be configured to prevent overly abrupt or forceful movement through use of one or more sealed or partially sealed air chambers (e.g., within lateral portion 176), springs, and/or other damping mechanism known in the art.

Figure 8:
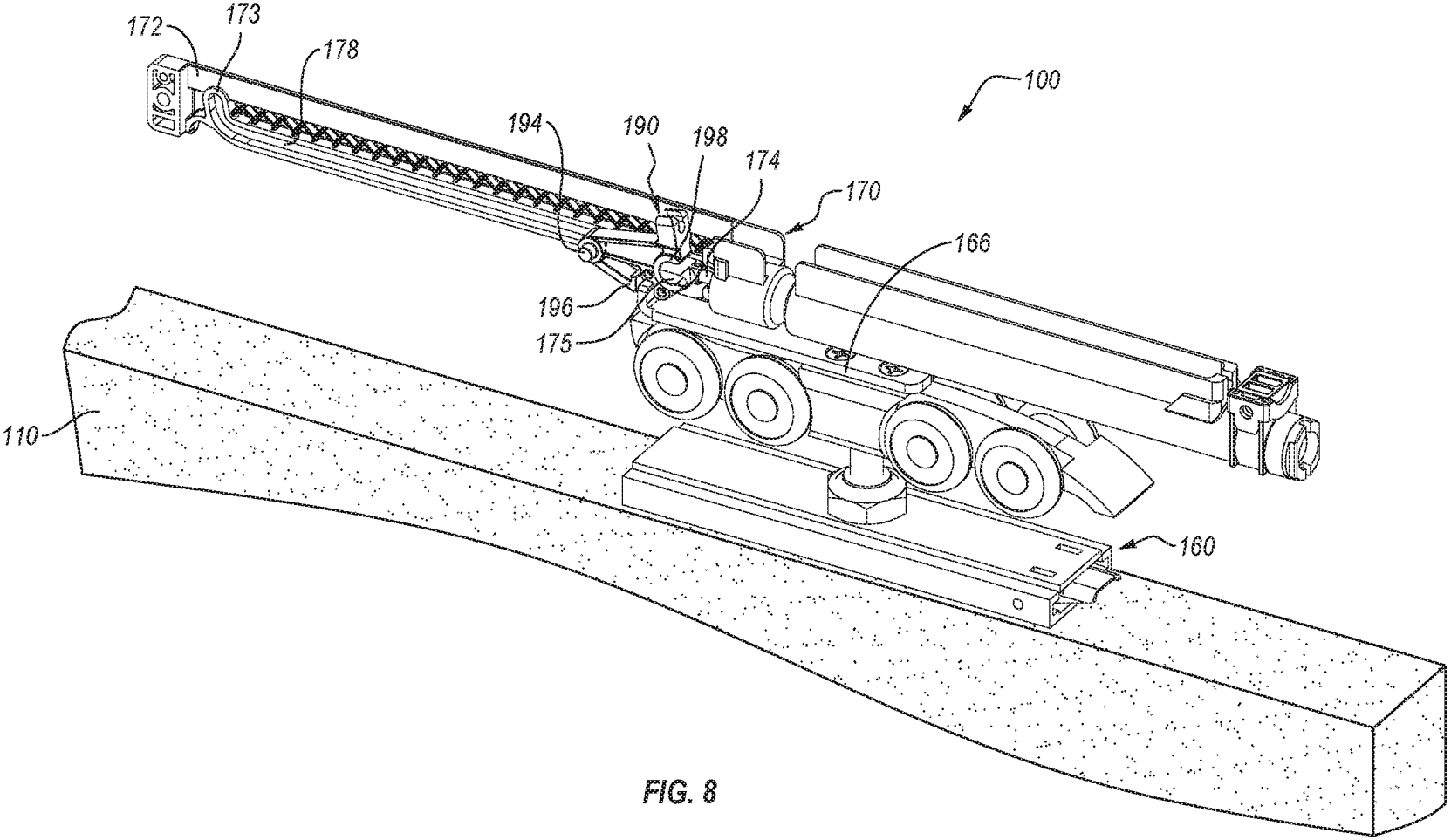

FIG. 8 illustrates the pocket door 110 in a fully closed position after the roller mechanism 160 has engaged with the damping mechanism 170 and has continued to move to the fully closed position. As noted above, the same structures and functions may also be applied to movement of the pocket door 110 toward the open position, and the use of terminology specific to closing the pocket door 110 is only used for the sake of convenience in describing this particular example.

As compared to FIG. 7, the roller mechanism 160 has moved further toward the closed position (i.e., to the right), thereby moving the catch 190 and the rod 174 further in the same direction. As shown, the catch 190 includes a pin 194 that extends outward into a catch channel 178 configured to secure the catch 190 within the damping mechanism 170. For example, the damping mechanism 170 may include such a catch channel 178 on both sides of the interior of the medial portion 172 (e.g., also on the section that has been removed for this particular view).

In the illustrated embodiment, the catch channel 178 includes a curved portion 173 configured to force the pin of the catch 190 upward when the catch 190 is moved toward the curved portion 173. This angling also forces the catch 190 to be angled upward when it reaches the curved portion 173. This allows the latch 166 to be released from the catch 190 so that the roller mechanism 160 and the pocket door 110 can move medially past the damping mechanism 170 when the door is reopened (i.e., moved to the left from the perspective of FIG. 8).

For example, as the pocket door 110 is moved, from the closed position of FIG. 8, toward an open position, the latch 166 will engage with a second face 196, which faces laterally and is configured to engage with the latch 166 as the roller mechanism 160 moves further toward an open position. As shown, as the latch 166 engages with the second face 196, movement of the roller mechanism 160 will cause corresponding movement of the catch 190 in the medial direction toward the curved portion 173 of the catch channel 178. As the catch pin 194 moves into the curved portion 173, the catch 190 is angled upwards to the configuration shown in FIG. 7. As shown in FIG. 7, when the catch 190 is angled upwards, the second face 196 is moved so as to be clear of the latch 166, such that the latch 166 may be moved further past the catch 190 as it continues in a medial direction as the pocket door 110 is opened.

In the illustrated embodiment, the catch 190 also includes a catch coupling section 198 configured to engage with the rod 174, such as with a corresponding rod coupling section 175, as shown). In the illustrated embodiment, the catch coupling section 198 is configured to allow some amount of rotation of the catch 190 relative to the rod 174. For example, as the catch 190 is angled upwards as a result of the curved section 173, the catch coupling section 198 rotates around the corresponding rod coupling section 175, and the coupling sections 198 and 175 are configured to provide sufficient clearance to allow rotation of the catch 190.

Accordingly, embodiments of the present disclosure provide pocket doors that can be easily and attractively integrated into a modular wall system. Additionally, embodiments of the present invention comprise pocket door assemblies that can be quickly and easily installed, adjusted, and otherwise accessed by simply removing one or more aesthetic panels.

Although the subject matter has been described in language specific to structural features and/or methodological acts, it is to be understood that the subject matter defined in the appended claims is not necessarily limited to the described features or acts described above, or the order of the acts described above. Rather, the described features and acts are disclosed as example forms of implementing the claims.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A modular wall system with an integrated pocket door, wherein the modular wall system comprises:

a frame at least partially defining a doorway and a wall;

one or more panels detachably connected to at least a portion of the frame;

a support member extending above the frame across at least a portion of the doorway and across at least a portion of the wall, the support member comprising an integrated track, the support member comprising;

a plurality of access windows integrated into the support member and providing access to an interior of the support member, the plurality of access windows being disposed at discrete locations along a length of the support member above the integrated track, wherein: (i) at least one access window is positioned above the doorway, and (ii) at least one access window is positioned above the wall; and a translatable pocket door engaging with the track of the support member, such that: (i) when closed, the pocket door blocks the doorway, and (ii) when open, the pocket door is at least partially enclosed behind the one or more panels.

2. The modular wall system of claim 1, further comprising one or more roller mechanisms coupled to the pocket door at a top of the pocket door and at least partially disposed within the integrated track of the support member.

3. The modular wall system of claim 2, wherein the one or more roller mechanisms are removable from the integrated track through the one or more access windows.

4. The modular wall system of claim 2, further comprising a damping mechanism configured to interact with the one or more roller mechanisms to dampen movement of the pocket door upon opening or shutting of the pocket door.

5. The modular wall system of claim 1, wherein the plurality of access windows are positioned so as to be behind the one or more panels when the one or more panels are attached to the frame.

6. The modular wall system of claim 1, further comprising one or more trim elements attached to the frame, wherein at least one of the one or more trim elements is configured to maintain the pocket door in a substantially coplanar position relative to the frame.

7. The modular wall system of claim 1, further comprising one or more trim elements attached to the frame, wherein at least one of the one or more trim elements is configured to restrict wobbling of the pocket door as the pocket door is moved between open and closed positions.

8. The modular wall system of claim 1, wherein the frame includes at least three vertical members, wherein a first and a second vertical member at least partially define the doorway, and wherein the second vertical member and a third vertical member at least partially define the wall.

9. The modular wall system of claim 8, wherein the frame further includes a plurality of horizontal frame members extending between the second and third vertical members, the horizontal frame members providing a coupling surface to which at least a portion of the one or more panels are attached.

10. The modular wall system of claim 1, further comprising a base frame member, the base frame member including a channel configured to receive a bottom portion of the pocket door to assist in guiding the pocket door as the pocket door is moved between open and closed positions.

11. The modular wall system of claim 10, wherein the pocket door is further supported by the base frame member.

12. The modular wall system of claim 10, further comprising a guide disposed at a bottom portion of the doorway, the guide being received into a channel of the pocket door, and the guide being configured to assist in guiding the pocket door as the pocket door is moved between open and closed positions.

13. The modular wall system of claim 1, wherein:

the translatable pocket door engages the track of the support member from a bottom side of the support member; and the one or more access windows provide access to a top side of the damping mechanism through one of the at least one access windows.

14. A modular wall system with an integrated pocket door, wherein the modular wall system comprises:

a frame at least partially defining a doorway and a wall;

a support member having an integrated track beneath the support member, the support member and integrated track extending across at least a portion of the doorway and across at least a portion of the wall;

a translatable pocket door configured to engage with the track of the support member such that when closed, the pocket door blocks the doorway, and when open, the pocket door is at least partially enclosed within the wall;

a roller mechanism coupled to the pocket door at a top of the pocket door and at least partially disposed within the integrated track of the support member; and a damping mechanism mounted to the support member above the integrated track, the damping member interacting with the roller mechanism to dampen movement of the pocket door upon opening or shutting of the pocket door, the dampening mechanism being disposed above the roller mechanism during interaction of the roller mechanism with the dampening mechanism;

wherein the support member comprises an access window that is integrated into the support member and into the integrated track, such that at least the damping mechanism and roller mechanism can be accessed through both the support member and the integrated track.

15. The modular wall system of claim 14, wherein the roller mechanism includes a latch, the latch being configured to engage with a catch of the damping mechanism as the roller mechanism passes underneath the damping mechanism, thereby enabling the damping mechanism to dampen movement of the pocket door.

16. The modular wall system of claim 15, wherein the catch is configured to engage with the latch as the roller mechanism moves laterally toward an open or closed position, and wherein the catch is configured to disengage from the latch as the roller mechanism moves medially away from the open or closed position.

17. The modular wall system of claim 16, wherein the catch is configured to disengage from the latch by angling away from the latch upon sufficient medial movement of the roller mechanism.

18. The modular wall system of claim 17, wherein:

the catch is positioned within the damping mechanism in a catch channel, the catch channel enabling the catch to translate within the damping mechanism, and the catch channel has an angled portion near a medial end of the damping mechanism that enables the catch to angle away from the latch upon the catch entering the angled portion.

19. The modular wall system of claim 14, further comprising one or more panels detachably connected to at least a portion of the frame.

20. The modular wall system of claim 14, further comprising one or more access windows integrated into the support member and providing access to an interior of the support member.

21. A modular wall system with an integrated pocket door, wherein the modular wall system comprises:

a frame at least partially defining a doorway and a wall;

one or more panels detachably connected to at least a portion of the frame;

a support member extending across at least a portion of the doorway and across at least a portion of the wall, the support member comprising an integrated track;

one or more access windows integrated into the support member and providing access to an interior of the support member, the one or more access windows being disposed at one or more discrete locations along a length of the support member above the integrated track, wherein: (i) at least one access window is positioned above the doorway, and (ii) at least one access window is positioned above the wall;

a translatable pocket door configured to engage with the track of the support member such that when closed, the pocket door blocks the doorway, and when open, the pocket door is at least partially enclosed behind the one or more panels;

a roller mechanism coupled to the pocket door at a top of the pocket door and at least partially disposed within the integrated track of the support member; and a damping mechanism interacting with the roller mechanism to dampen movement of the pocket door upon opening or shutting of the pocket door, the dampening mechanism being disposed above the roller mechanism during interaction of the roller mechanism with the dampening mechanism.

22. A modular wall system with an integrated pocket door, wherein the modular wall system comprises:

a frame at least partially defining a doorway and a wall;

a support member having an integrated track beneath the support member, the support member and integrated track extending across at least a portion of the doorway and across at least a portion of the wall;

a translatable pocket door configured to engage with the track of the support member such that when closed, the pocket door blocks the doorway, and when open, the pocket door is at least partially enclosed within the wall;

a first roller mechanism coupled to the pocket door at a top, forward location, and at least partially disposed within the integrated track of the support member;

a second roller mechanism coupled to the pocket door at a top, rearward location, and at least partially disposed within the integrated track of the support member; and first and second damping mechanisms mounted to the support member above the integrated track, the first damping mechanism being mounted above the doorway with the second damping mechanism being mounted above the wall;

wherein:

each damping mechanism interacts with the corresponding first or second roller mechanism at a point above the first or second roller mechanism to dampen movement of the pocket door upon opening or shutting of the pocket door; and an access window formed in both the support member and integrated track provides access to an upper portion of the first or second damping member.

* * * * *